United States Patent [19]

Stekoll et al.

[11] 4,159,094

[45] Jun. 26, 1979

[54] SPRING STEEL CHAIN ELEMENTS AND PLANT HANGER ASSEMBLY

[76] Inventors: Marion H. Stekoll, 1092 Florence Way, Campbell, Calif. 95008; Harry Dahlhauser, 1855 Russell Ave., Santa Clara, Calif. 95050

[21] Appl. No.: 854,980

[22] Filed: Nov. 25, 1977

Related U.S. Application Data

[63] Continuation of Ser. No. 698,792, Jun. 21, 1976, abandoned.

[51] Int. Cl.[2] ..... B42F 13/00

[52] U.S. Cl. ..... 248/318; D6/113; 47/67

[58] Field of Search ..... 248/317, 318; 59/3, 59/25; D6/113, 137; 47/67, 82, 83

[56] References Cited

U.S. PATENT DOCUMENTS

| | | | |
|---|---|---|---|
| D. 77,225 | 12/1928 | Danz | D6/113 |
| D. 222,949 | 2/1972 | Souder | D6/113 |
| 1,077,423 | 11/1913 | Myers | 47/67 |
| 2,190,129 | 2/1940 | Stahl | 59/25 |
| 3,228,577 | 1/1966 | Croft | 224/42.46 |
| 4,032,102 | 6/1977 | Wolf et al. | 47/67 |

OTHER PUBLICATIONS

"Indoor Gardener's Book," Kramer, Jack, 1974.
Vogue, "Plant Pot Holders," 11-76, p. 25.
"Home Horticulture," 9-1975, p. 66.

*Primary Examiner*—Robert A. Hafer
*Attorney, Agent, or Firm*—Limbach, Limbach & Sutton

[57] ABSTRACT

A plant hanger assembly and supporting spring steel chain element are disclosed including a round, flat bottom pan with sidewalls positioned substantially 11 degrees to the vertical and chain links of 13 gauge spring steel three inches long which can be snapped together for hanging pans one above the other.

2 Claims, 4 Drawing Figures

SPRING STEEL CHAIN ELEMENTS AND PLANT HANGER ASSEMBLY

This application is a continuation of application Ser. No. 698,792 filed June 21, 1976 by these inventors and now abandoned.

BACKGROUND OF THE INVENTION

The present invention relates in general to a plant hanger assembly and a spring steel chain element used therein.

Many different types of plant hanging baskets and support grills have been constructed in the past of many different materials. In most instances the particular material selected for hanging the plant supporting member, either pot, grill or latticework, is not adapted for easy adjustment of the vertical position of the plant or positioning one plant above another. Additionally, many materials for hanging, such as string, rope, jute, etc., are twisted, braided, woven or knotted, hiding a good portion of the plant when enough material is used to provide adequate support. Additionally, the type of hanging materials are often susceptible to weathering and have a relatively limited life when used for hanging plants out of doors.

THE PRESENT INVENTION

In accordance with the present invention, a unique assemblable and disassemblable and adjustable plant hanging assembly is provided. The assembly includes a pan provided with a flat bottom and an upwardly directed sidewall inclined at a small angle, typically 11 degrees, to a normal projecting upwardly from the flat bottom and provided with a plurality of apertures spaced around the upward periphery thereof. The pan is supported by a chain made up of a plurality of unique chain elements or links. Each link is a spring steel wire member bent into a narrow elongate and closed loop, with the opposite ends of the wire meeting substantially midway of one side of the loop and having a ratio of wire thickness to loop length substantially 0.03 inches.

With the construction of the present invention a strong chain assembly is provided, but wherein the divided side of each loop of each link can be bent sideways to open the loop for connecting or disconnecting the link element with other link elements. The chain assembly can be connected to the aperture in the sides of the pan and one or more pans positioned at selected vertically spaced-apart positions. With the specified small angle to the sidewall of the pans, one chain link can be connected through the aperture in the sidewall projecting upwardly therefrom for supporting the pan and another chain link connected to the one chain link at the lower end thereof and hanging down from the pan to support a second pan, free from engagement with the sidewall of the first pan.

With the thin, strong chain links, very little disruption is provided to the foliage of the plants positioned on the pans.

The plant hanging assembly can be packed and sold in disassembled form, with the pans easily stacking, one on the other, and the chain compressed in a small volume.

These and other features and advantages will become more apparent upon a perusal of the following specification taken in conjunction with the accompanying drawings wherein similar characters of reference refer to similar structures in each of the several views.

DESCRIPTION OF THE PREFERRED EMBODIMENT

Figure 1:
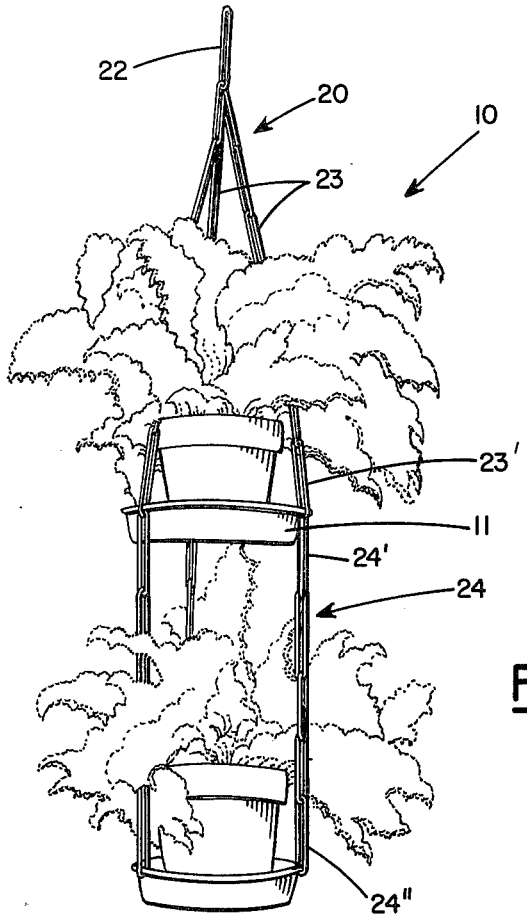
FIG. 1 is a vertical view of the present invention, illustrating a plant hanging assembly with several plants, and illustrating the unique chain link.
Figure 2:
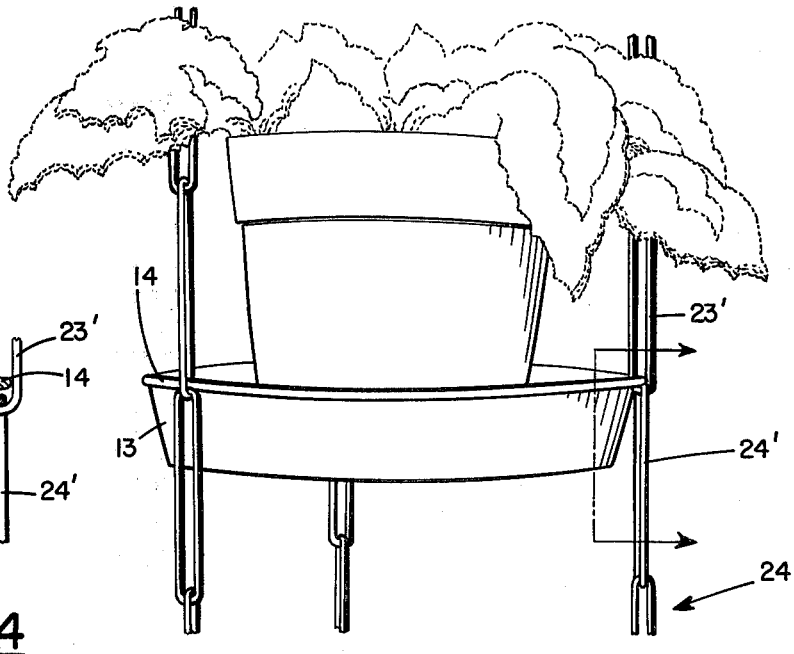
FIG. 2 is an enlarged view of a portion of the structure shown in FIG. 1.
Figure 4:
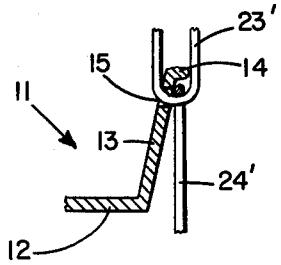
FIG. 4 is an enlarged vertical sectional view of a portion of the structure shown in FIG. 3 delineated by line 3—3.
Figure 3:
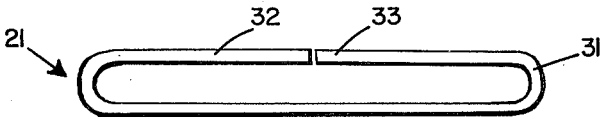
FIG. 3 is an enlarged view showing the chain link of the present invention.

Referring now to the drawings, there is shown a plant hanger assembly 10 including a plurality of pans 11 such as of aluminum painted in one of various colors which are supported by a chain generally designated 20 as will be described in greater detail below. Each pan includes the round flat bottom 12 and an upwardly outwardly angled side wall 13, a turned over bead 14 is provided at the upper end of the side wall 13 and a plurality of apertures 15 are provided equally spaced about the side wall 13 adjacent the bead 14. The side wall 13 makes a small angle with a normal to the flat bottom 12 of the pan. With the particular chain lengths that will be described hereinafter it has been found that an angle of eleven degrees between the side wall and the normal to the bottom of the pan produces the desired result of enabling chain lengths to support pans directly beneath one another with straight lengths of chain between pans.

The chain assembly 20 includes a plurality of chain links 21 connected together and appropriate ones of which are connected to the pans. As shown in the particular illustrative embodiment the chain assembly includes a top length 22 from which depend a plurality of first pan support lengths 23 each consisting of an equal number of links and the bottom link 23' passes through one of the apertures 15 so that the first or top most pan 11 is supported at equally spaced apart locations by the support lengths 23.

A second, and possibly additional, pans 11 are supported beneath the upper most pan 11 by lower support lengths 24 of chain which are connected to the lower most link 23' by an upper link 24' the upper end of which is looped through the lower end of the lower most link 23' of the respective support lengths 23. The lower most link 24'' of the lower support length 24 passes through an aperture in the second highest pan 11 for support of that pan and further support of other support lengths of chain for supporting other pans therebelow. It will be seen that the angled side wall 13 permits the support lengths 24 to hang vertically below the support lengths 23 and permit both vertical structural support as well as a pleasing aesthetic appearance. The angled side walls of the pans also permit the pans to nest within one another for shipment and compact display of the pans at the point of sale.

The chain link 21 is unique in its construction which enables easy assembly and disassembly of the plant hanger in accordance with this invention while at the same time providing a strong support assembly. Each link 21 is made up of a thick elongate spring steel wire 31 bent into a narrow elongate enclosed loop with the opposite ends of the wire 32 and 33 meeting substantially midway of one side of the loop and having a ratio of wire thickness to loop length of substantially 0.03 inches. For ease in enabling different configurations of support chains the link 21 must not only be strong but sufficiently flexible so that the link can be sprung open at the ends 32 and 33 of the wire 31 connecting different links 21 as desired. It has been discovered that for 13-gauge spring steel wire with a loop width of 7/16 inches a loop length of three inches is needed for providing a chain link which can be depressed with the fingers to provide the proper spacing between the wire ends 32 and 33 for connecting links together and looping links into the apertures 15 of the pans. Links as short as possible are desired. It has been found that a two-inch long link of such wire is too short and that a two and one-half inch long link provides greater than desired resistence to bending of the ends of the wire to achieve the necessary spacing between ends.

It will be appreciated that different configurations of support chain assemblies can be utilized to support the number of pans desired. The chain link assembly provides not only a strong support, but one which is easily assembled and disassembled to produce a variety of different desired configurations with a structure that produces a minimum obstruction to the foilage of a plant that is positioned on the pans. While the pans may be made of a number of possible materials the selection of aluminum is particularly desired to avoid the possibility of rusting in the wet environment.

What is claimed is:

1. A plant hanger assembly comprising, in combination, at least a first and second pan adapted to support a plant pot, each pan having a flat bottom and an upwardly inclined side wall making a small angle with an upwardly directed normal from the flat bottom, a plurality of apertures equally spaced around the upper periphery of the said wall, a first support chain assembly including for each aperture a plurality of chain links interconnected together with one link connected through the aperture of said first pan, and a second support chain assembly connected to said first support chain assembly at a lower end thereof so as to hang vertically down to support said second pan free from engagement with said side wall of said first pan, each of said links comprising a thin elongate spring steel wire member bent into a narrow elongate and closed loop with the opposite ends of the wire meeting substantially midway of one side of the loop and with the ratio of wire thickness of said loop to the length of said loop being substantially 0.03.

2. The plant hanger assembly of claim 1 wherein said small angle between said side wall and a normal to said first and said second pan is substantially eleven degrees and wherein said loop is substantially three inches long and 7/16 inches wide.

* * * * *